US010927796B2

(12) United States Patent
Lee et al.

(10) Patent No.: US 10,927,796 B2
(45) Date of Patent: Feb. 23, 2021

(54) EGR CONTROL METHOD APPLIED WITH HUMIDITY SENSOR FOR PREVENTING CONDENSATION

(71) Applicants: Hyundai Motor Company, Seoul (KR); Kia Motors Corporation, Seoul (KR)

(72) Inventors: Kyu-Min Lee, Anyang-si (KR); Jun-Sik Park, Seoul (KR); Dong-Suk Chae, Seoul (KR); Cheol-Soo Park, Yongin-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 84 days.

(21) Appl. No.: 16/506,787

(22) Filed: Jul. 9, 2019

(65) Prior Publication Data

US 2020/0182204 A1 Jun. 11, 2020

(30) Foreign Application Priority Data

Dec. 11, 2018 (KR) ..... 10-2018-0159472

(51) Int. Cl.
*F02M 26/50* (2016.01)
*F02M 26/49* (2016.01)

(52) U.S. Cl.
CPC ..... *F02M 26/50* (2016.02); *F02M 26/49* (2016.02)

(58) Field of Classification Search
CPC ..... F02M 26/50; F02M 26/49; F02M 26/33; F02D 2200/0418; F02D 2200/703; F02D 2200/021; F02D 41/005; F02D 41/0047; F02D 41/04; F02D 29/02; F02D 2200/0414; F02D 2200/0416
See application file for complete search history.

(56) References Cited

U.S. PATENT DOCUMENTS

| | | | | |
|---|---|---|---|---|
| 10,156,212 | B2 * | 12/2018 | Yokono | F02D 41/144 |
| 2014/0150755 | A1 * | 6/2014 | Cunningham | F02M 31/10 123/563 |
| 2015/0114346 | A1 * | 4/2015 | Surnilla | F02D 11/105 123/349 |
| 2017/0022940 | A1 * | 1/2017 | Minami | F02B 29/0443 |
| 2017/0145903 | A1 * | 5/2017 | Sadakane | F02M 26/33 |
| 2017/0306894 | A1 * | 10/2017 | Kikuchi | F02M 26/32 |
| 2018/0135569 | A1 * | 5/2018 | Han | F02M 26/46 |
| 2019/0186430 | A1 * | 6/2019 | Shinagawa | F28D 20/003 |
| 2019/0368448 | A1 * | 12/2019 | Arakawa | F02D 41/2451 |
| 2020/0157989 | A1 * | 5/2020 | Patil | F02B 29/0468 |

* cited by examiner

*Primary Examiner* — Joseph J Dallo
*Assistant Examiner* — Kurt Philip Liethen
(74) *Attorney, Agent, or Firm* — Morgan, Lewis & Bockius LLP

(57) ABSTRACT

An exhaust gas recirculation (EGR) control method applied with a humidity sensor for preventing condensation to prevent corrosion caused by exhaust gas in a vehicle, may include a first step of measuring a temperature, humidity, and atmospheric pressure of intake air which is introduced from the outside of the vehicle and flows into the EGR; a second step of determining a molar fraction of water vapor included in the intake air by a combustion equation of the water vapor and determining water vapor pressure in the EGR; and a third step of opening an EGR valve so that EGR gas flows when the water vapor pressure in the EGR is lower than saturated water vapor pressure in the EGR.

7 Claims, 5 Drawing Sheets

EGR CONTROL METHOD APPLIED WITH HUMIDITY SENSOR FOR PREVENTING CONDENSATION

CROSS-REFERENCE TO RELATED APPLICATIONS

The present application claims priority to Korean Patent Application No. 10-2018-0159472, filed on Dec. 11, 2018, the entire contents of which is incorporated herein for all purposes by this reference.

BACKGROUND OF THE INVENTION

Field of the Invention

The present invention relates to an EGR control method applied with a humidity sensor for preventing condensation, and particularly, to a method of variably controlling an operating temperature of a coolant of EGR by measuring a temperature or humidity of outside air.

Description of Related Art

Recently, there is a demand for a new technology of improving fuel economy to cope with $CO_2$ emission regulations which become stricter in many countries and to meet consumers' demands for high-efficiency vehicles. A thermal loss and a frictional loss are great because of a low temperature when an engine is initially started, and for the present reason, fuel economy deteriorates. Therefore, development on thermal management technologies is increased because it is possible to improve fuel economy by rapidly warming up the engine when the engine is initially started.

Meanwhile, an exhaust heat recovery device, which is disposed at a rear end portion of a catalyst and also used as an LP-EGR cooler among thermal management systems applied to vehicles, is configured to raise temperatures of an engine coolant and oil by rapidly warming up the engine when the engine is initially started.

However, because of a problem with combustion stability and a problem with condensation, LP-EGR is not used in a cold state of the engine when the engine is initially started, but the LP-EGR is used when a temperature of the coolant is raised to a predetermined temperature or higher.

In this regard, Korean Patent Application Laid-Open No. 2005-0070259 in the related art (Method of Controlling EGR Device for Vehicle) may include a method of controlling an exhaust gas recirculation (EGR) device configured for a vehicle, which controls a duty of the EGR device based on an intake air temperature, preventing a temperature of an EGR valve from being raised while the vehicle travels in the summer season or in a tropical region.

However, the method in the related art operates EGR by determining only whether the intake air temperature is equal to or higher than a predetermined reference temperature (fixed temperature), and as a result, there are problems in that an operating region of the EGR is reduced and condensation occurs in accordance with outside air and fuel quality.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an EGR control method applied with a humidity sensor for preventing condensation, which measures a temperature for operating the EGR under all weather conditions instead of a fixed temperature.

Various aspects of the present invention are directed to providing an exhaust gas recirculation (EGR) control method applied with a humidity sensor for preventing condensation to prevent corrosion caused by exhaust gas in a vehicle, the EGR control method including: a first step of measuring humidity of intake air which is introduced from the outside of a vehicle and flows into the EGR; a second step of determining a molar fraction of water vapor included in the intake air by a combustion equation of the water vapor and determining water vapor pressure in the EGR; and a third step of opening an EGR valve so that EGR gas flows when the water vapor pressure in the EGR is lower than saturated water vapor pressure in the EGR.

The first step may further include: a step of measuring the temperature, the humidity, and the atmospheric pressure of the intake air; and a step of determining a humidity content of the intake air based on the temperature, the humidity, and the atmospheric pressure.

The second step may further include: a step of determining a composition ratio of gas included in the intake air by the combustion equation; a step of determining the total number of moles based on the composition ratio and determining a molar fraction of the gas included in the intake air by use of a mass conservation equation; and a step of determining the water vapor pressure in the EGR by multiplying pressure in the EGR by the molar fraction.

The third step may further include: a step of measuring a temperature in the EGR; and a step of determining the saturated water vapor pressure in the EGR by determining saturated water vapor pressure when gas, which is identical to gas existing in the EGR, exists at a temperature in the EGR.

The temperature in the EGR may be measured based on a temperature of a coolant in an engine and measured by any one of an engine inlet coolant temperature sensor and an engine outlet coolant temperature sensor based on a connection position between the EGR and the engine.

The third step may further include a step of closing the EGR valve so that the EGR gas does not flow when the water vapor pressure in the EGR is equal to or greater than the saturated water vapor pressure in the EGR.

The third step may further include a step of supplying the coolant to an exhaust gas recirculation (EGR) cooler by operating a coolant flow rate control valve before opening the EGR valve.

According to an exemplary embodiment of the present invention configured as described above, the operating region of EGR is not limited to a temperature but may be enlarged, and as a result, there is an advantage in that it is possible to cope with a change in weather.

Furthermore, according to an exemplary embodiment of the present invention, there are advantages in that it is possible to reduce development costs and management costs which are incurred due to the development on dualization of the vehicle/dualization of the engine, and marketability is not restricted by fuel quality.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
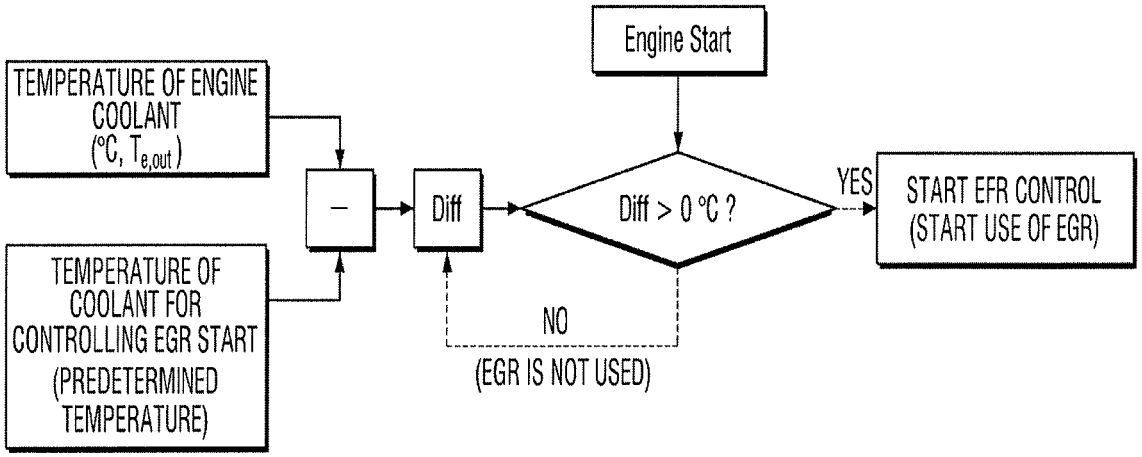
FIG. 1 is a view exemplarily illustrating a general configuration of a method of controlling an EGR device in the related art.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, the present invention will be described in detail with reference to the accompanying drawings. However, the present invention is not restricted or limited by exemplary embodiments. Like reference numerals indicated in the respective drawings refer to members which perform substantially the same functions.

An object and an effect of the present invention may be naturally understood or may become clearer from the following description, and the object and an effect of the present invention are not restricted only by the following description. Furthermore, in the description of the present invention, the specific descriptions of publicly known technologies related with the present invention will be omitted when it is determined that the specific descriptions may unnecessarily obscure the subject matter of the present invention.

FIG. 1 is a view exemplarily illustrating a general configuration of a method of controlling an EGR device in the related art. Referring to FIG. 1, the related art prevents the occurrence of condensation in an exhaust gas recirculation (EGR) cooler by starting an EGR operation only when a temperature of a coolant, which flows into the EGR, is a predetermined temperature or higher to prevent condensation in the EGR cooler.

In the instant case, a fixed temperature value of the coolant is set, and the EGR is used after an engine is warmed up to a predetermined temperature or higher. However, because the EGR is operated only when the fixed temperature of the coolant is the predetermined temperature or higher, there is a problem in that condensation occurs in accordance with an outside air state and fuel quality.

In addition, as a problem, (1) the operating region of the EGR is decreased. The controlling of the temperature of the coolant fixed to cope with various environmental conditions consequently delays a point in time for using the EGR in MODE or certified fuel economy sections or practical fuel economy sections, and for the present reason, an effect of improving fuel economy is halved. For example, fuel economy may deteriorate, by about 0.2% in the case of a gamma engine, in a case in which a reference temperature related to an operating temperature of the coolant is raised by 52° C.~60° C. in an FTP certification mode. (2) It is not possible to basically prevent the occurrence of condensation under all weather conditions. Typically, an operable temperature of the coolant of the EGR is approximately 55 to 60° C. under a condition in which an environmental temperature, which is a certified fuel economy measurement condition, is 20 to 30° C. (based on humidity of 40 to 50%). Condensation occurs even at maximum of 66° C. in consideration of a location where a discomfort index (dew point temperature) is high among locations all over the worlds. (3) The use of a cooled EGR system is restricted due to fuel quality. As described above, a problem with quality may consequently occur because it is basically difficult to perfectly prevent condensation and a sulfur content is large at a location where fuel quality is poor. As a result, the EGR system cannot be applied to a location where fuel quality is poor or in a country where fuel which is poor quality may be used. That is, there are problems in that development costs and management costs are increased and marketability deteriorates because of the development on dualization of vehicles/dualization of engines. In the present location, the operating temperature of the coolant was greatly raised (60° C.~70° C.) and high-grade SUS, which is a material of a heat exchanger and has high corrosion-resistance, was applied, and the vehicles are mass-produced, such that costs was greatly increased (3000 KRW ↑) and fuel economy of the vehicle deteriorated by about 0.3%.

Figure 2A:
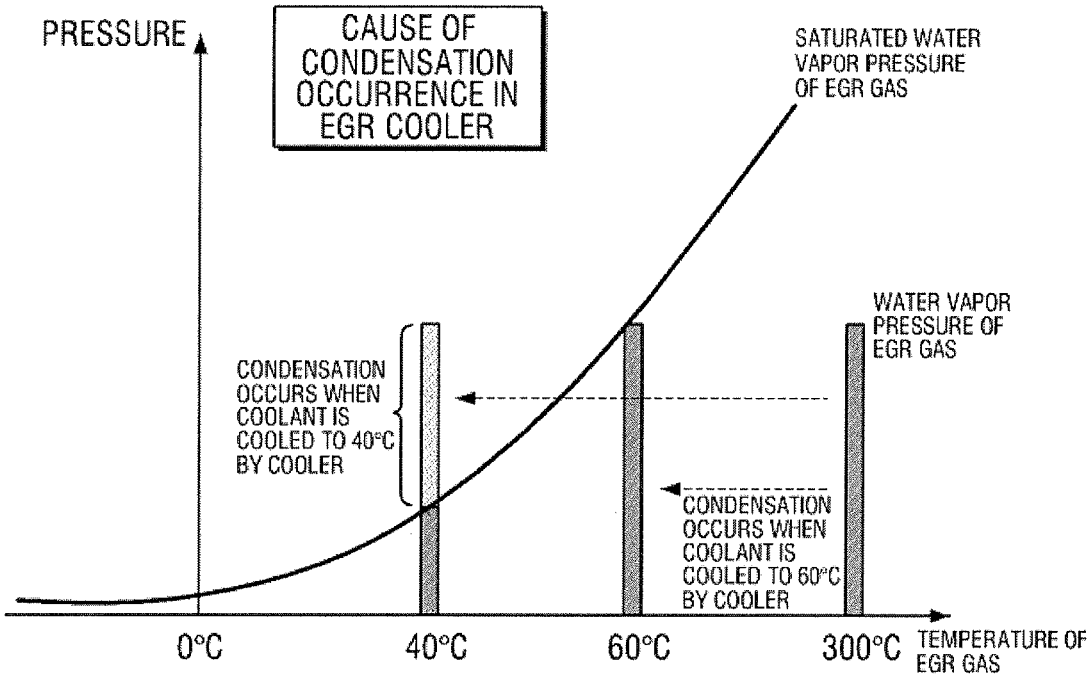
FIG. 2A and FIG. 2B are views exemplarily illustrating a state in which condensation occurs when saturated water vapor pressure of exhaust gas in the EGR device in the related art is decreased to be lower than water vapor pressure.
Figure 2B:
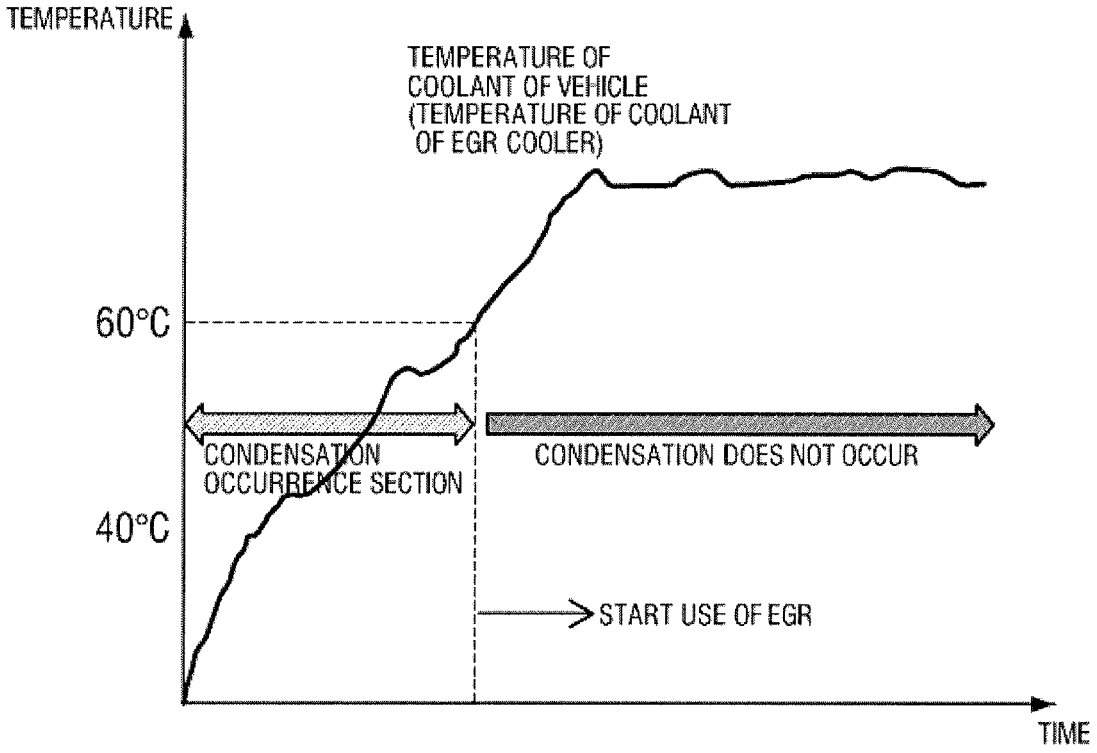

FIG. 2 is a view exemplarily illustrating a state in which condensation occurs when saturated water vapor pressure of exhaust gas in the EGR device in the related art is decreased to be lower than water vapor pressure. Referring to FIG. 2, FIG. 2A illustrates a curve of saturated water vapor pressure of EGR gas, and FIG. 2B illustrates a state in which no condensation occurs as the EGR is used.

FIG. 2A illustrates a state in which condensation occurs in the EGR cooler when the coolant is cooled from 60° C. to 40° C., and FIG. 2B illustrates a state in which no condensation occurs as the temperature of the coolant, when the EGR operation is started, is set to be higher than a temperature at which saturated water vapor pressure and water vapor pressure become equal to each other. The present invention may adjust the temperature of the coolant for controlling EGR start based in a state of intake air by the present principle, as illustrated in FIG. 3 and FIG. 4.

Figure 3:
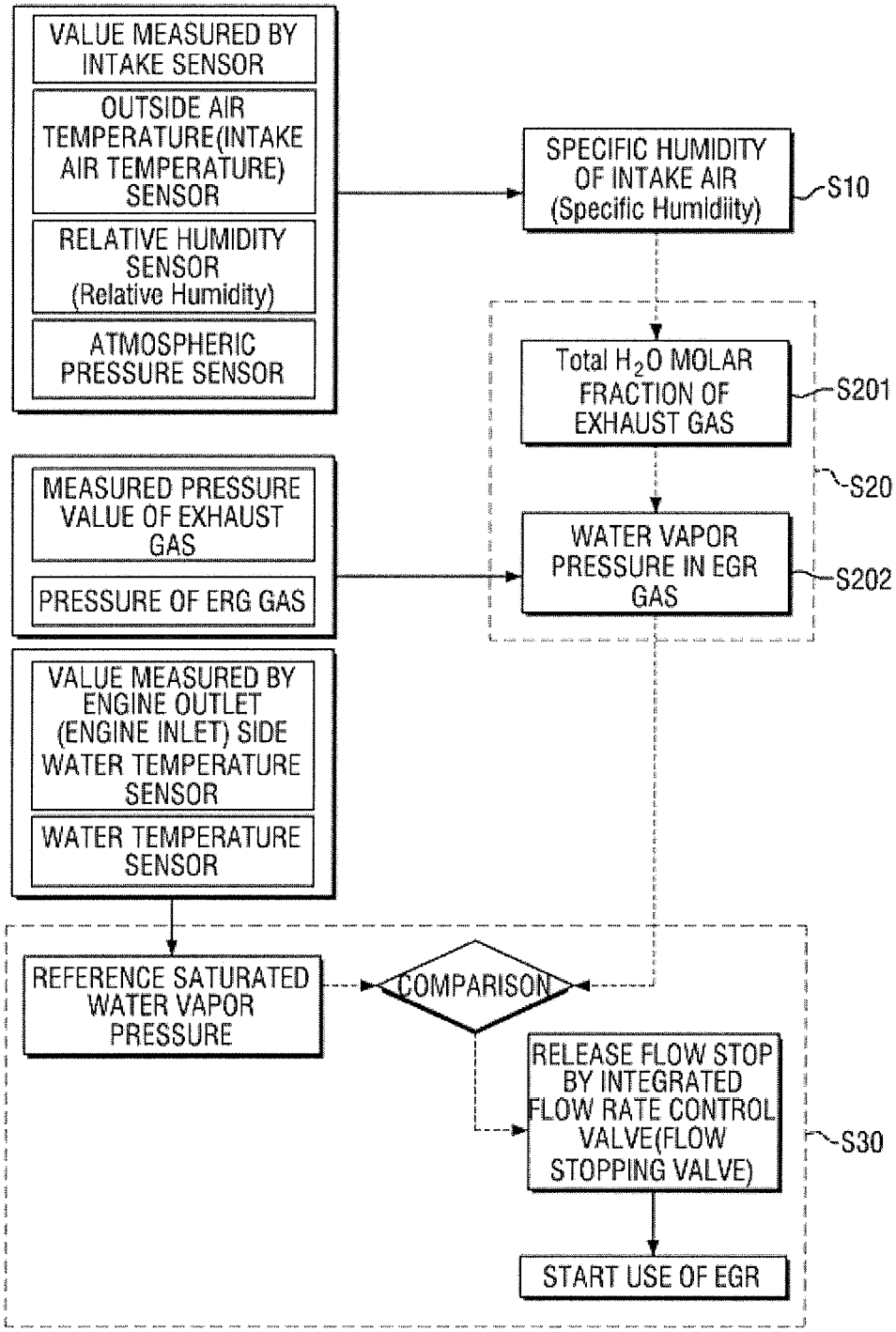
FIG. 3 is a flowchart of an EGR control method applied with a humidity sensor according to an exemplary embodiment of the present invention.
Figure 4:
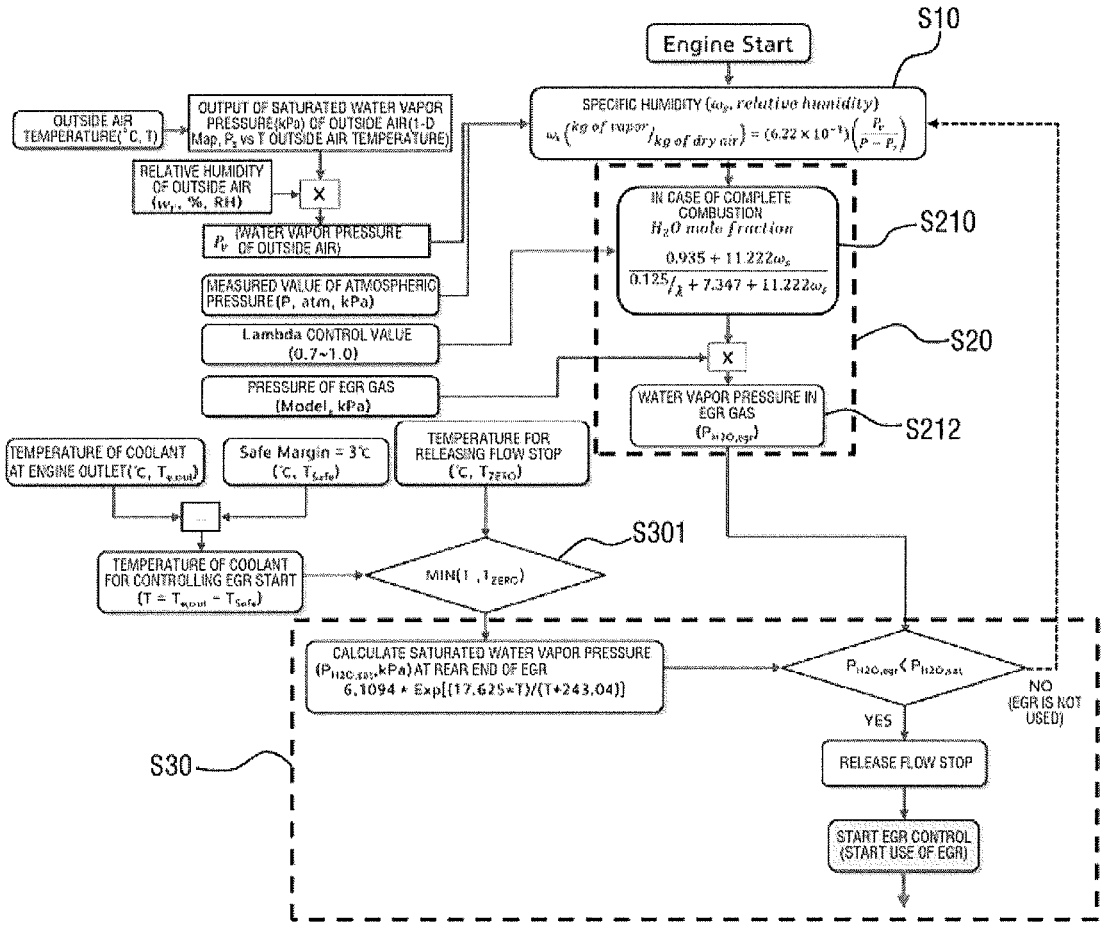
FIG. 4 is a view exemplarily illustrating a detailed process of the flowchart of the EGR control method applied with the humidity sensor according to an exemplary embodiment of the present invention.

FIG. 3 is a flowchart of an EGR control method applied with a humidity sensor according to an exemplary embodiment of the present invention. Referring to FIG. 3, the present control method may include three steps.

In an exemplary embodiment of the present invention, the flowchart of an EGR control method is configured to be performed by a controller.

The controller may be at least one microprocessor operated by a predetermined program which may include a series of commands for carrying out a method in accordance with various exemplary embodiments of the present invention.

In the first step S10, a temperature, humidity, and atmospheric pressure of intake air which is introduced from the outside of the vehicle and flows into EGR are measured. In the first step S10, a humidity content of the intake air is determined based on the temperature, the humidity, and the atmospheric pressure.

In the second step S20, a molar fraction of water vapor included in the intake air is determined by a combustion equation of the water vapor, and water vapor pressure in the EGR is determined. The second step S20 may further include a step of determining a composition ratio of gas included in the intake air by the combustion equation, a step (S201) of determining the total number of moles based on a composition ratio and determining a molar fraction of gas included in the intake air by use of a mass conservation equation, and a step (S202) of determining water vapor pressure in the EGR by multiplying pressure in the EGR by the molar fraction.

In the third step S30, when the water vapor pressure in the EGR is lower than the saturated water vapor pressure in the EGR, an EGR valve is opened so that the EGR gas flows. The third step S30 may further include a step of closing the EGR valve so that the EGR gas does not flow when the water vapor pressure in the EGR is equal to or greater than the saturated water vapor pressure in the EGR. Furthermore, the third step S30 may further include a step of supplying the coolant to the EGR cooler by operating a coolant flow rate control valve before opening the EGR valve.

FIG. 4 is a flowchart of the EGR control method applied with the humidity sensor according to the exemplary embodiment of the present invention. FIG. 4 illustrates details of the first to third steps S10 to S30 illustrated in FIG. 3.

In the first step S10, the humidity content of the intake air is determined by measuring the temperature, the humidity, and the atmospheric pressure of the intake air. The measurement may be performed by a general sensor, and the humidity content, that is, the amount of moisture included in the intake air may be ascertained.

The second step S20 is a step of determining the molar fraction of the water vapor included in the intake air by the combustion equation and determining the water vapor pressure in the EGR. The combustion equation is as follows. This step is a step of determining the composition ratio of the gas included in the intake air by the combustion equation.

$$(1-x_r)\left[C_nH_{1.87n}+\left(\frac{n+\frac{1.87n}{4}}{\Phi}\right)(O_2+\psi N_2+\omega H_2O)\right]+ x_r(\alpha CO_2+\beta H_2O+\gamma N_2+\delta C_nH_{1.87n})\rightarrow \alpha CO_2+\beta H_2O+\gamma N_2+\delta C_nH_{1.87n}$$

Here, the molar fraction of the gas is obtained to determine the molar fraction of the water vapor. To the present end, the numbers of elements are compared.

C balance $$(1-x_r)n+x_r(\alpha+n\delta)=\alpha+n\delta$$

$$(1-x_r)n=(1-x_r)(\alpha+n\delta)$$

$$n=\alpha+n\delta$$

(2) O balance $$(1-x_r)n\left(\frac{1.4675}{\Phi}\right)(2+\omega)+x_r(2\alpha+\beta)=2\alpha+\beta$$

$$(1-x_r)n\left(\frac{1.4675}{\Phi}\right)(2+\omega)=(1-x_r)(2\alpha+\beta)$$

$$n\left(\frac{1.4675}{\Phi}\right)(2+\omega)=2\alpha+\beta$$

When comparing elements H and N by use of Equations (1) and (2) and the combustion equation, the composition ratio of the exhaust gas to the remaining gas (EGR gas) is not changed. Therefore, the molar fraction of the gas may be determined by the following mass conservation equation. This process is a process of determining the total number of moles based on the composition ratio and determining the molar fraction of the gas included in the intake air by use of the mass conservation equation.

$$C_nH_{1.87n}+\left(\frac{n+\frac{1.87n}{4}}{\Phi}\right)(O_2+\psi N_2+\omega H_2O)= \alpha CO_2+\beta H_2O+\gamma N_2+\delta C_nH_{1.87n}$$

C balance $$n=\alpha+n\delta \qquad \text{Equation 1}$$

(2) O balance $$n\left(\frac{1.4675}{\Phi}\right)(2+\omega)=2\alpha+\beta \qquad \text{Equation 2}$$

(3) H balance $$1.87n+n\left(\frac{1.4675}{\Phi}\right)(2\omega)=2\beta+1.87n\delta \qquad \text{Equation 3}$$

(4) N balance $$n\left(\frac{1.4675}{\Phi}\right)\psi=\gamma$$

by Equations 1 to 3,

Equation including variables α and β may be obtained by Equation 1*1.87—Equation 3.

$$\begin{array}{ll} & 1.87n = 1.87\alpha+1.87n\delta \\ - & 1.87n+n\left(\frac{1.4675}{\Phi}\right)(2\omega)=2\beta+1.87n\delta \end{array} \qquad \text{Equation 4}$$

-continued $$-n\left(\frac{1.4675}{\Phi}\right)(2\omega) = 1.87\alpha - 2\beta$$

The variable α may be obtained by Equation 2*2+Equation 4.

$$\begin{array}{rl} & \left| 2n\left(\frac{1.4675}{\Phi}\right)(2+\omega) = 4\alpha + 2\beta \right. \\ + & \left| -n\left(\frac{1.4675}{\Phi}\right)(2\omega) = 1.87\alpha - 2\beta \right. \\ \hline & n\left(\frac{5.87}{\Phi}\right) = 5.87\alpha \therefore \alpha = \frac{n}{\Phi} \end{array}$$

$$C_nH_{1.87n} + \left(\frac{n + \frac{1.87n}{4}}{\Phi}\right)(O_2 + \psi N_2 + \omega H_2O) = \alpha CO_2 + \beta H_2O + \gamma N_2 + \delta C_nH_{1.87n}$$

δ is obtained by putting a value of α into Equation 1.

$$n = \alpha + n\delta \qquad \therefore \delta = 1 - \frac{1}{\Phi}$$
$$= \left(\frac{n}{\Phi}\right) + n\delta$$

β is obtained by putting a value of α into Equation 2.

$$n\left(\frac{1.4675}{\Phi}\right)(2+\omega) = 2\left(\frac{n}{\Phi}\right) + \beta \quad \therefore \beta = 0.935\left(\frac{n}{\Phi}\right) + 1.4675\left(\frac{n}{\Phi}\right)\omega$$

The total number of moles ($n_{total}$) of reactants as described above is as follows.

$$n_{total} = \alpha + \beta + \gamma + \delta = \left(\frac{n}{\Phi}\right) + \left[0.935\left(\frac{n}{\Phi}\right) + 1.4675\left(\frac{n}{\Phi}\right)\omega\right] + n\left(\frac{1.4675}{\Phi}\right)\psi + \left[1 - \frac{1}{\Phi}\right]$$

The number of moles $n_{H2O}$ of water vapor is as follows.

$$n_{H_2O} = \beta = \left[0.935\left(\frac{n}{\Phi}\right) + 1.4675\left(\frac{n}{\Phi}\right)\omega\right]$$

The molar ratio ($x_{H2O}$) of water vapor is as follows.

$$\chi_{H_2O} = \frac{n_{H_2O}}{n_{total}} = \frac{\left[0.935\left(\frac{n}{\Phi}\right) + 1.4675\left(\frac{n}{\Phi}\right)\omega\right]}{\left(\frac{n}{\Phi}\right) + \left[0.935\left(\frac{n}{\Phi}\right) + 1.4675\left(\frac{n}{\Phi}\right)\omega\right] + n\left(\frac{1.4675}{\Phi}\right)\psi + \left[1 - \frac{1}{\Phi}\right]}$$

Assuming that Ψ=3.773 and n=8 (typically, at a level of average 7 to 8, gasoline has the same molar ratio of water vapor with respect to n)

$$\chi_{H_2O} = \frac{n_{H_2O}}{n_{total}} = \frac{\left[0.935\left(\frac{n}{\Phi}\right) + 1.4675\left(\frac{n}{\Phi}\right)\omega\right]}{\left(\frac{n}{\Phi}\right) + \left[0.935\left(\frac{n}{\Phi}\right) + 1.4675\left(\frac{n}{\Phi}\right)\omega\right] + n\left(\frac{1.4675}{\Phi}\right)\psi + \left[1 - \frac{1}{\Phi}\right]}$$

$w_s$: Specific Humidity (kg of vapor/kg of dry air) where $W_r = P_v/P_s$ Relative Humidity $$w_s = \frac{m_v}{m_a} = \frac{\frac{P_vV}{R_vT}}{\frac{P_aV}{R_aT}} = \frac{R_aP_v}{R_vP_a} = \frac{M_vP_v}{M_aP_a} =$$

$$0.622\frac{P_v}{P_a} = 0.622\frac{P_v}{P - P_v} = 0.622\frac{P_v/P_s}{P/P_s - P_v/P_s} = 0.622\frac{w_r}{P/P_s - w_r}$$

$P_v$: vapor partial pressure $P_a$: dry air partial pressure (without vapor)

$P_s$: saturated vapor pressure $P$: total air pressure (with vapor)

$R_a$: gas constant of dry air $R_v$: gas constant of vapor $M_a$: Molacular weight of dry air (28.86 g/mole)

$R_v$: Molacular weight of vapor (18 g/mole)

Assuming that N2 is 3.773 moles and wet vapor is ω moles with respect to $O_2$ of 1 mole in intake air, the specific humidity is as follows.

$$w_s = \frac{m_v}{m_a} = \frac{m_{H_2O}}{m_{O_2} + m_{N_2}} = \frac{(16+2)\omega}{32 + 3.773 * 28} = \frac{18\omega}{137.644} = \frac{\omega}{7.647}$$

Air and wet vapor, which flow into intake air, are assumed as ideal gas because of low saturated vapor pressure thereof, $(M_v/M_a) = (16+2)/(0.21 * 32 + 0.79 * 28) \cong 0.622$ Assuming that Ψ=3.773 and n=8, the molar fraction of water vapor when Φ=1 is as follows.

$$\chi_{H_2O} = \frac{n_{H_2O}}{n_{total}} = \frac{\left[0.935\left(\frac{n}{\Phi}\right) + 1.4675\left(\frac{n}{\Phi}\right)\omega\right]}{\left(\frac{n}{\Phi}\right) + \left[0.935\left(\frac{n}{\Phi}\right) + 1.4675\left(\frac{n}{\Phi}\right)\omega\right] + n\left(\frac{1.4675}{\Phi}\right)\psi + \left[1 - \frac{1}{\Phi}\right]}$$

$$\therefore \chi_{H_2O} = \frac{n_{H_2O}}{n_{Total}} = \frac{0.935 + 1.4675\omega}{7.472 + 1.4675\omega} = \frac{0.935 + 11.222\omega_s}{7.472 + 11.222\omega_s}$$

A step of determining the water vapor pressure in the EGR by multiplying the pressure in the EGR by the molar fraction may be further included. The water vapor pressure in the EGR gas may be determined by multiplying the pressure of the EGR gas in the EGR cooler by the molar fraction by use of the pressure of the exhaust gas in the EGR. In the instant case, in a case in which a model value of the pressure of the exhaust gas is used, a value made by measuring and correcting an actual value may be used.

The third step is a step of maintaining the EGR valve when the water vapor pressure in the EGR is equal to or greater than the saturated water vapor pressure in the EGR.

In the instant case, the third step may further include a step of measuring the temperature in the EGR, and a step of determining the saturated water vapor pressure in the EGR by determining the saturated water vapor pressure when gas, which is identical to the gas existing in the EGR, exists at a temperature in the EGR.

The pressure of the exhaust gas in the EGR is equal to or insignificantly different from pressure at an extraction portion, such that the pressure at front and rear end portions of the EGR cooler is hardly decreased. The saturated water vapor pressure may be derived by assuming that there is water vapor having a temperature equal to the temperature of the coolant in the EGR cooler. In the instant case, as the saturated water vapor pressure, a model value of pressure of water vapor in accordance with a temperature may be used, and the model value may be directly used or a known correlation equation may be used.

$$P_{H_2O}=6.1094e^{(17.675T)/(T+243.04)}\quad T=\text{Air temperature}$$

For example, in the case in which the equation for detecting the saturated water vapor pressure is used as described above, the reference saturated water vapor pressure may be outputted by use of an engine inlet coolant temperature sensor when the coolant, which flows into the EGR cooler, is connected to an engine inlet side coolant line, and using an engine outlet coolant temperature sensor when the coolant is connected to an engine outlet side coolant line, based on the position of the EGR cooler.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An exhaust gas recirculation (EGR) control method applied with a humidity sensor for preventing condensation to prevent corrosion caused by exhaust gas in a vehicle, the EGR control method including:

a first step of measuring, by a controller, a temperature, humidity, and atmospheric pressure of intake air which is introduced from the outside of the vehicle and flows into the EGR;

a second step of determining, by the controller, a molar fraction of water vapor included in the intake air by a combustion equation of the water vapor and determining water vapor pressure in the EGR; and a third step of opening, by the controller, an EGR valve so that EGR gas flows when the water vapor pressure in the EGR is lower than saturated water vapor pressure in the EGR.

2. The EGR control method of claim 1, wherein the first step further includes:

a step of determining a humidity content of the intake air based on the temperature, the humidity, and the atmospheric pressure.

3. The EGR control method of claim 1, wherein the second step further includes:

a step of determining a composition ratio of gas included in the intake air by the combustion equation;

a step of determining a total number of moles based on the composition ratio and determining a molar fraction of the gas included in the intake air by use of a mass conservation equation; and a step of determining the water vapor pressure in the EGR by multiplying pressure in the EGR by the molar fraction.

4. The EGR control method of claim 1, wherein the third step further includes:

a step of measuring a temperature in the EGR; and a step of determining the saturated water vapor pressure in the EGR by determining the saturated water vapor pressure when gas, which is identical to gas existing in the EGR, exists at a temperature in the EGR.

5. The EGR control method of claim 4, wherein the temperature in the EGR is measured based on a temperature of a coolant in an engine and measured by one of an engine inlet coolant temperature sensor and an engine outlet coolant temperature sensor based on a connection position between the EGR and the engine.

6. The EGR control method of claim 1, wherein the third step further includes a step of closing the EGR valve so that the EGR gas does not flow when the water vapor pressure in the EGR is equal to or higher than the saturated water vapor pressure in the EGR.

7. The EGR control method of claim 1, wherein the third step further includes a step of supplying a coolant to an EGR cooler by operating a coolant flow rate control valve before opening the EGR valve.

* * * * *